US008721501B2

(12) United States Patent
Wu

(10) Patent No.: US 8,721,501 B2
(45) Date of Patent: May 13, 2014

(54) DETECTION DEVICE AND MONITORING SYSTEM FOR DETECTING AN EXERCISING STATE

(76) Inventor: Mu-Chuan Wu, Tainan (TW)

( * ) Notice: Subject to any disclaimer, the term of this patent is extended or adjusted under 35 U.S.C. 154(b) by 27 days.

(21) Appl. No.: 13/537,709

(22) Filed: Jun. 29, 2012

(65) Prior Publication Data

US 2014/0005002 A1 Jan. 2, 2014

(51) Int. Cl.
*A63B 24/00* (2006.01)

(52) U.S. Cl.
USPC ..... 482/7; 482/1; 482/8; 482/901

(58) Field of Classification Search
USPC ..... 482/1–9, 900–902
See application file for complete search history.

(56) References Cited

U.S. PATENT DOCUMENTS

| | | | | |
|---|---|---|---|---|
| 5,839,990 | A * | 11/1998 | Virkkala | 482/8 |
| 6,152,856 | A * | 11/2000 | Studor et al. | 482/8 |
| 6,244,988 | B1 * | 6/2001 | Delman | 482/8 |
| 8,025,607 | B2 * | 9/2011 | Ranky et al. | 482/8 |

* cited by examiner

*Primary Examiner* — Glenn Richman
(74) *Attorney, Agent, or Firm* — WPAT, P.C.; Anthony King

(57) ABSTRACT

A detection device and a monitoring system are adapted to detect an exercising state of a user. The detection device is adapted to be equipped on a circulation exercise device of a physical training equipment. The detection device has a state detector and a rotation speed detector. The state detector generates multiple signal combinations based on a periodic motion of the circulation exercise device. The rotation speed detector estimates a relative variation between a rotation speed and degrees of the circulation exercise device based on the signal combinations. The relative variation represents the user's exercising state. According to the relative variation, a user can realize whether the exercising state is in balance.

16 Claims, 8 Drawing Sheets

DETECTION DEVICE AND MONITORING SYSTEM FOR DETECTING AN EXERCISING STATE

BACKGROUND OF THE INVENTION

1. Field of the Invention

The present invention relates to a detection device and a monitoring system for detecting an exercising state, and more particularly to a detection device and a monitoring system for detecting whether the exercising state of a user is in balance.

2. Description of Related Art

The advantages of exercising are well known. Doing exercises not only strengthens the heart and lungs, but also improves blood circulation. In order to do exercise in a limited indoor space, presently most of the gyms have physical training equipments, such as exercise bikes. A user can also buy an exercise bike to do exercise at home.

In general, a conventional exercise bike is equipped with a fitness monitor. The fitness monitor can display physical information of the user, such as heart rhythm and calorie consumption. However, the user just only gets the information about the present fitness states. The user cannot learn whether the exercise posture is accurate and appropriate or not from the fitness monitor.

For example, every user is used to do exercises in a certain posture. When the user rides the exercise bike, the force supplied from the right foot and the left foot may not be balanced. The force supplied from the left foot may be larger than that supplied from the right foot. If a force difference between the left foot and the right foot is large, the force difference will become a burden of the user. As time passes, the force difference easily affects the physical coordination of the user. The risk of being injured exists.

SUMMARY OF THE INVENTION

An objective of the present invention is to provide a detection device and a monitoring system for detecting an exercising state. The detection device is equipped on a circulation exercise device of a physical training equipment. When a user does exercise on the physical training equipment, the detection device in accordance with the present invention can estimate whether the user exercises in a balanced state.

To achieve the foregoing objective, the detection device in accordance with the present invention comprises a state detector and a rotation speed detector.

The state detector generates multiple signal combinations based on a periodic motion of the circulation exercise device.

The rotation speed detector is electrically connected to the state detector and estimates a relative variation between a rotation speed and degrees of the circulation exercise device based on the signal combinations. The relative variation represents a user's exercising state.

To achieve the foregoing objective, the monitoring system in accordance with the present invention comprises multiple detection devices, a data collector and a monitoring system.

The multiple detection devices are respectively equipped on multiple circulation exercise devices of physical training equipments. Each detection device comprises a state detector, a rotation speed detector and a wireless transmission module.

The state detector generates multiple signal combinations based on a periodic motion of the circulation exercise device.

The rotation speed detector is electrically connected to the state detector and estimates a relative variation between a rotation speed and degrees of the circulation exercise device based on the signal combinations. The relative variation represents a user's exercising state.

The wireless transmission module is electrically connected to the rotation speed detector and is adapted to send out information of the angle and the rotation speed.

The data collector has a wireless transmission module communicating with the wireless transmission modules of the devices to receive information of the angle and the rotation speed from the devices.

The monitoring host communicates with the data collector to read information of the angle and the rotation speed.

Taking an exercise bike for an example, a gear of the exercise bike is regarded as the circulation exercise device. Two cranks are respectively mounted on two sides of the gear. Each crank connects a treadle. A user can step on the treadles by feet when the user is riding the exercise bike. The rotation speed detector can generate a waveform chart based on the relative variation between the rotation speed of the gear and the degrees of the crank.

When the user rides the exercise bike, the user sequentially uses his/her right foot and left foot to exert pressure on the treadles. Each time one of the feet exerts pressure on the treadle, the rotation speed of the gear rises. Hence, if the user does exercise in a balanced manner, two rotation speed peaks will appear in the waveform chart. The two peaks respectively indicate working states of the left foot and the right foot. If the user does exercise in an unbalanced manner, the rotation speed peaks will not appear in the waveform chart, or the amplitudes of the peaks may be much different from each other.

Above all, the user can adjust his/her exercising posture based on the waveform chart to do exercises in accurate, appropriate and balance postures. The risk of being injured decreases.

DETAILED DESCRIPTION OF THE PREFERRED EMBODIMENT

Figure 1:
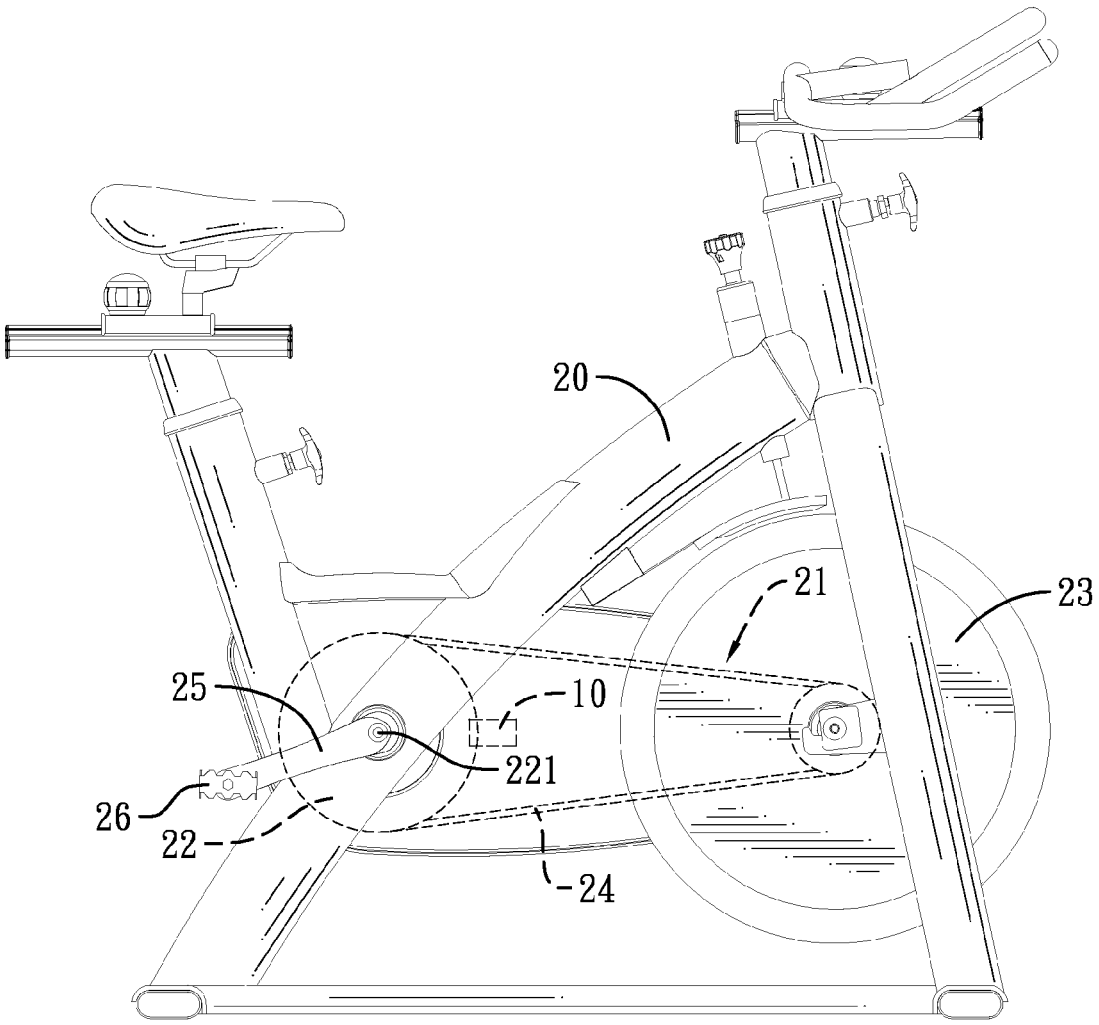
FIG. 1 is plan view of a detection device in accordance with the present invention equipped on an exercise bike.
Figure 2:
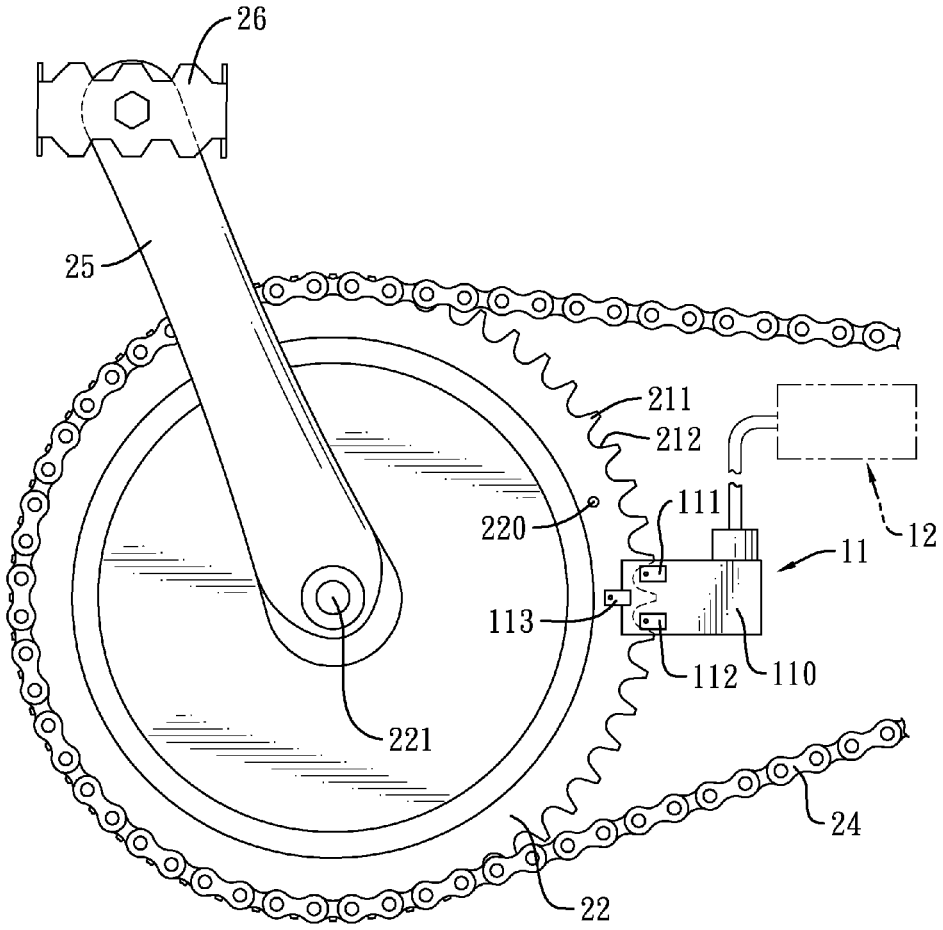
FIG. 2 is a plan view of the detection device in accordance with the present invention and a circulation exercise device.

With reference to FIG. 1 and FIG. 2, a detection device 10 in accordance with the present invention equipped on a circulation exercise device 21 of a physical training equipment 20 is illustrated. In this embodiment, the physical training equipment 20 is an exercise bike.

The circulation exercise device 21 has multiple light blockers 211 and multiple breaches 212. The light blockers 211 and the breaches 212 are arranged alternately and move along a circular motion trace. The circulation exercise device 21 of the exercise bike comprises a gear 22, a flywheel 23 and a chain 24. The chain 24 connects the gear 22 to the flywheel 23. The gear 22 has an edge, an aperture 220, multiple salients and multiple notches. The salients and the notches are formed on the edge. The salients are regarded as the light blockers 211. The notches are regarded as the breaches 212. The circular motion traces of the aperture 220, light blockers 211 and the breaches 212 are concentric circles, wherein the centers of the concentric circles are located in an axle center 221 of the gear 22.

Two opposite sides of the gear 22 respectively connect to two cranks 25. Each crank 25 pivotally connects to a treadle 26. When a user steps on the treadles 26, the gear 22 rotates to revolve the flywheel 23.

The detection device 10 in accordance with the present invention comprises a state detector 11 and a rotation speed detector 12.

The state detector 11 generates multiple signal combinations based on a periodic motion of the circulation exercise device 21. With reference to FIG. 2, the state detector 11 comprises a circuit board 110, a first light sensor 111, a second light sensor 112 and an aperture sensor 113.

The sensors 111-113 are mounted on the circuit board 110. The first light sensor 111 and the second sensor 112 are located at the circular motion trace of the light blockers 211 and the breaches 212 and both keep a gap from the light blockers 211 and the breaches 212. The aperture sensor 113 is located at the circular motion trace of the aperture 220 and keeps a gap from the aperture 220.

The first and the second light sensors 111,112 respectively detect the light blockers 211 and the breaches 212 and generate detecting signals. The aperture sensor 113 detects the aperture 220 and generates a zeroization signal. Taking the first light sensor 111 for an example, when a light beam emitted from the first light sensor 111 is blocked by the light blockers 211 or passes through the breaches 212, the first light sensor 111 correspondingly generates detecting signals in different states. The detecting signals can be represented as digital signals of "0" or "1".

Figure 3A:
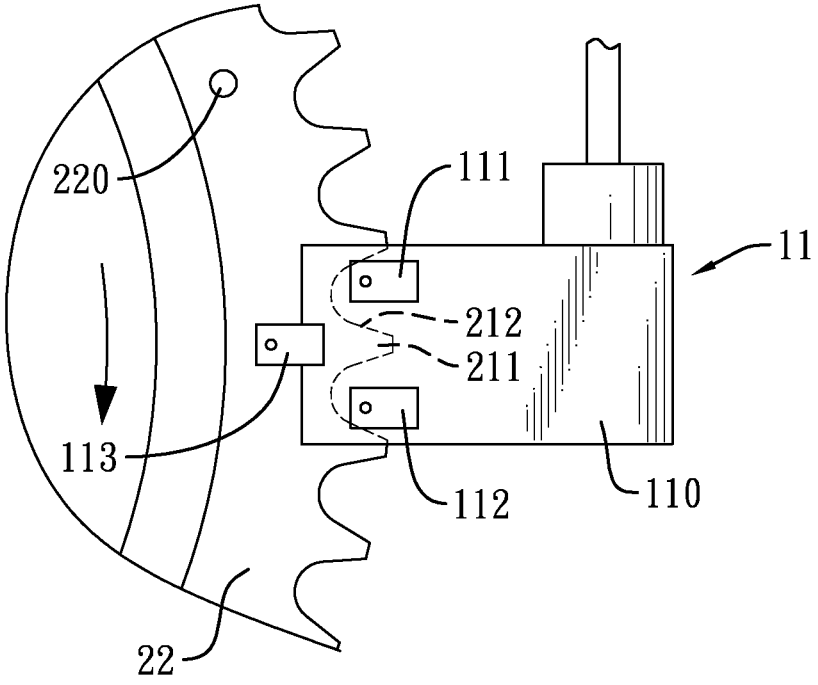
FIGS. 3A-3D are operating views of a first and a second light sensor of the detection device of the present invention.

With reference to FIG. 3A, if the first and the second light sensors 111,112 detect the breaches 212 at the same time, both of the first and the second light sensors 111,112 will generate detecting signals of "1". The signal combination can be represented as "11".

Figure 3B:
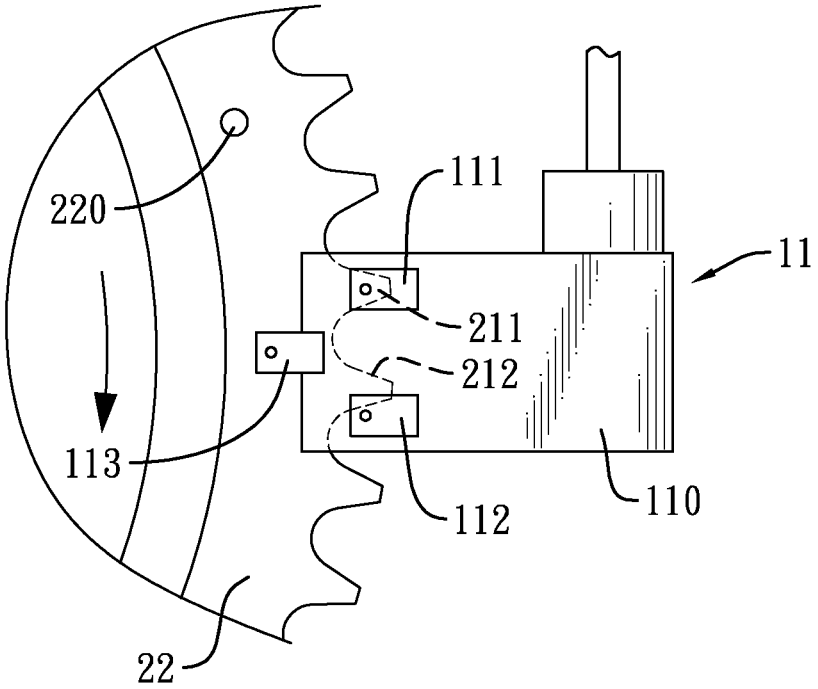

With reference to FIG. 3B, if the first light sensor 111 detects the light blocker 211 and the second light sensor 112 detects the breach 212, the first light sensor 111 will generate detecting signal of "0" and the second light sensor 112 will generate detecting signal of "1". The signal combination can be represented as "01".

Figure 3C:
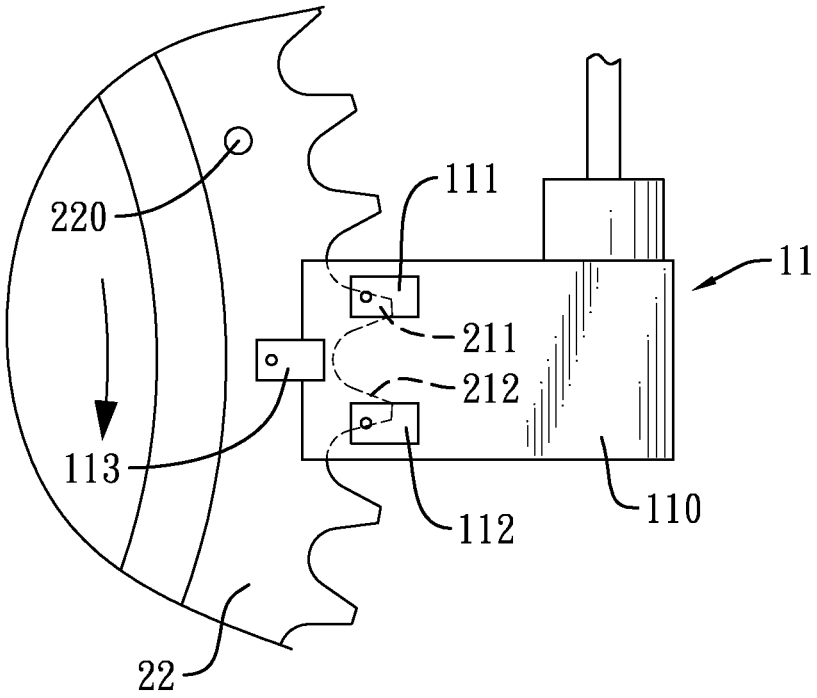

With reference to FIG. 3C, if the first and the second light sensors 111,112 detect the light blockers 211 at the same time, both of the first and the second light sensors 111,112 will generate detecting signals of "0". The signal combination can be represented as "00".

Figure 3D:
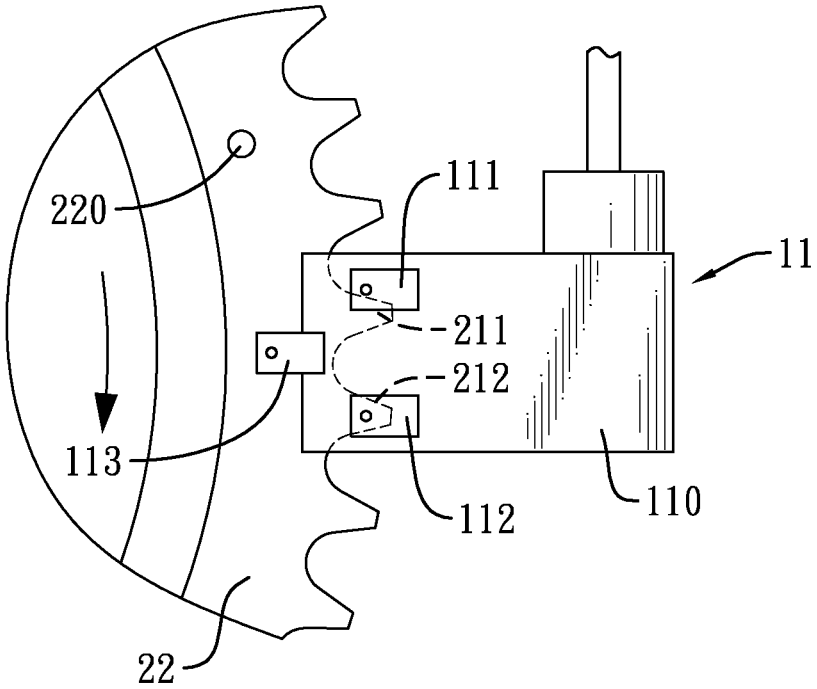

With reference to FIG. 3D, if the first light sensor 111 detects the breach 212 and the second light sensor 112 detects the light blocker 211, the first light sensor 111 will generate detecting signal of "1" and the second light sensor 112 will generate detecting signal of "0". The signal combination can be represented as "10".

When the gear 22 rotates, the light blockers 211 and the breaches 212 pass over the first and the second light sensors 111,112 alternately. Therefore, the first and the second light sensor 111,112 sequentially generate signal combinations of "11", "01", "00" and "10". Hence, the signal combinations represent the periodic motion of the circulation exercise device 21.

Figure 4:
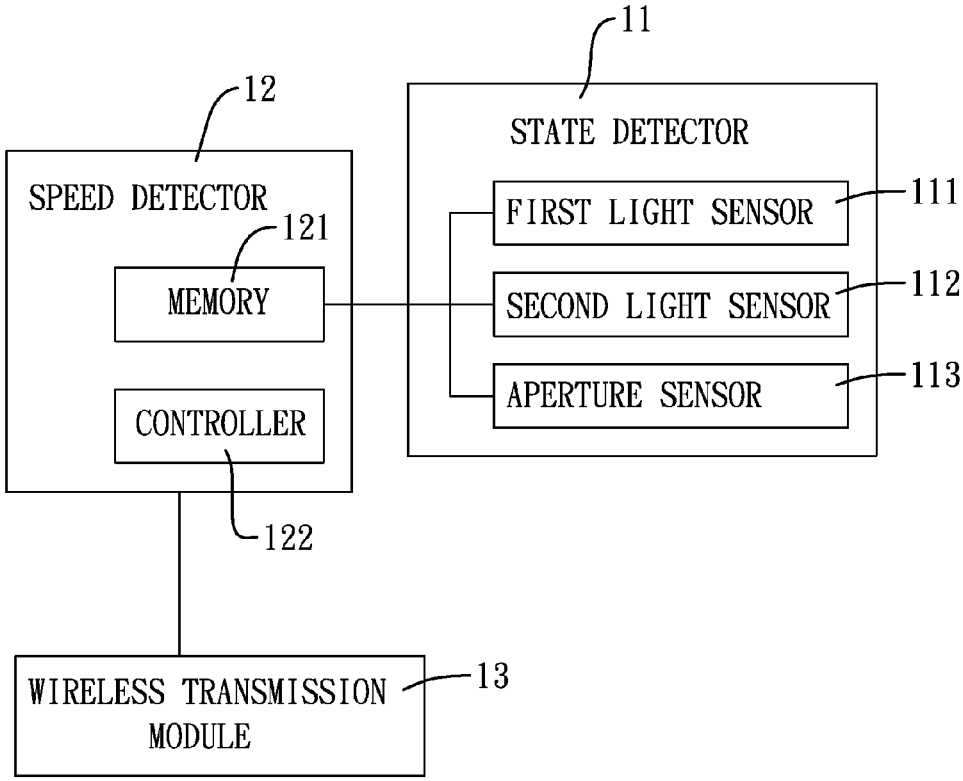
FIG. 4 is a block diagram of the detection device in accordance with the present invention.

With reference to FIG. 4, the rotation speed detector 12 comprises a memory 121 and a controller 122.

The memory 121 is electrically connected to the first light sensor 111 and the second light sensor 112 to store the signal combinations generated from the first light sensor 111 and the second light sensor 112. The signal combinations in the memory 121 form a periodic queue, such as . . . "11," "01," "00," "10," etc.

The controller 122 is electrically connected to the memory 121 and the aperture sensor 113. The controller 122 reads the periodic queue from the memory 121 and defines a serial number pk to each signal combination in the periodic queue.

Figure 5:
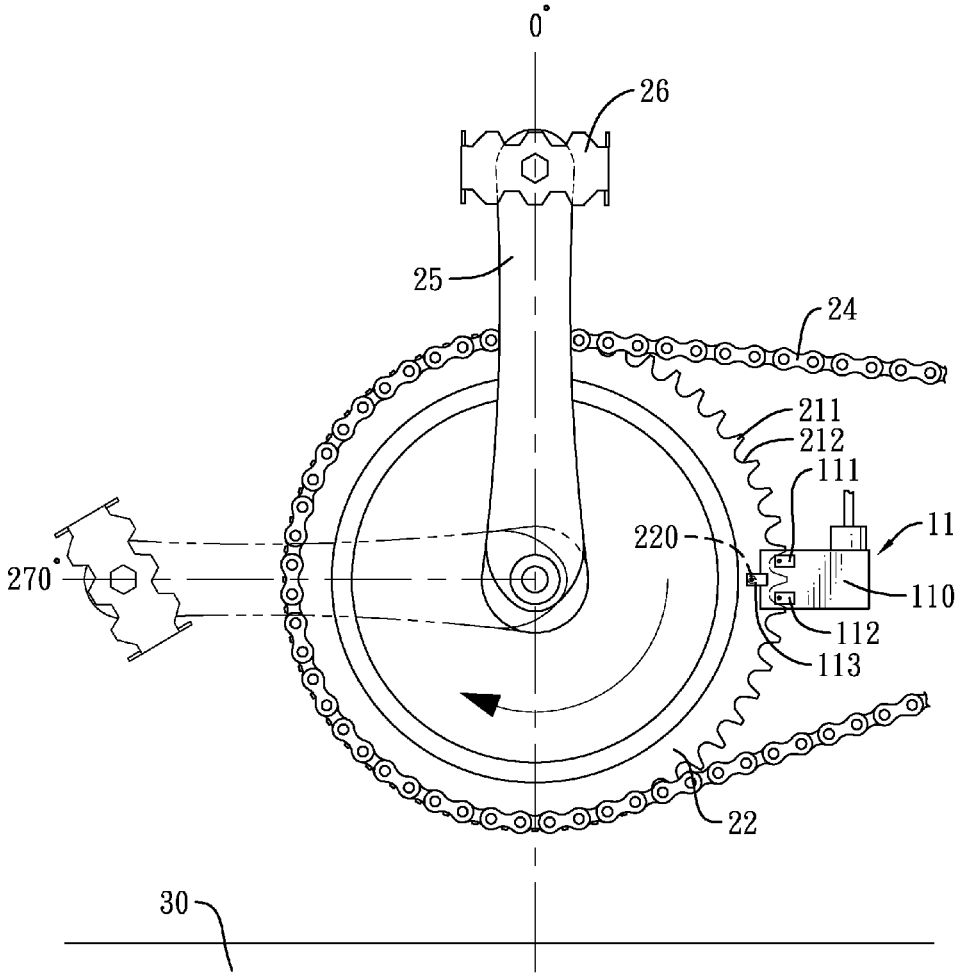
FIG. 5 is a plan view of the detection device in accordance with the present invention and a circulation exercise device.

For example, the gear 22 has n light blockers 211. An included angle between two adjacent light blockers 211 can be represent as m°, where m°=360°/n. With reference to FIG. 5, in this embodiment, when the crank 25 is situated vertically and upward from a horizontal plane 30, the controller 122 may define the included angle between the crank 25 and the horizontal plane 30 as a reference angel, such as 0°. Meanwhile, the position of the aperture 220 is correspondingly opposite to the aperture sensor 113, so that the aperture sensor 113 can determine the aperture 220.

When the aperture sensor 113 determines the aperture 220, the aperture sensor 113 generates a zeroization signal. The controller 122 regards the zeroization signal as an initial point for defining the serial numbers pk.

When a user steps on the treadles 26 to revolve the gear 22, the memory 121 stores the signal combinations from the first and the second light sensors 111,112. The controller 122 defines a serial number pk to each signal combination, such as 1, 2, . . . , pk, pk+1, . . . , n. Then the controller 122 can estimate an instantaneous angle θ° of the crank 25 based on the serial numbers pk, wherein θ°=pk*m°.

The controller 122 can estimate the rotation speed T2/T1 of the gear 22, wherein T1 is a duration of time in which the gear 22 finishes a complete revolution and T2 is a unit of time. The controller 122 can estimate a time interval between two zeroization signals and takes the time interval as T1. If the unit of time T2 is 60 seconds (one minute), the RPM (revolutions per minute) of the gear 22 is $$RPM = \frac{60}{T1}.$$

Figure 6:
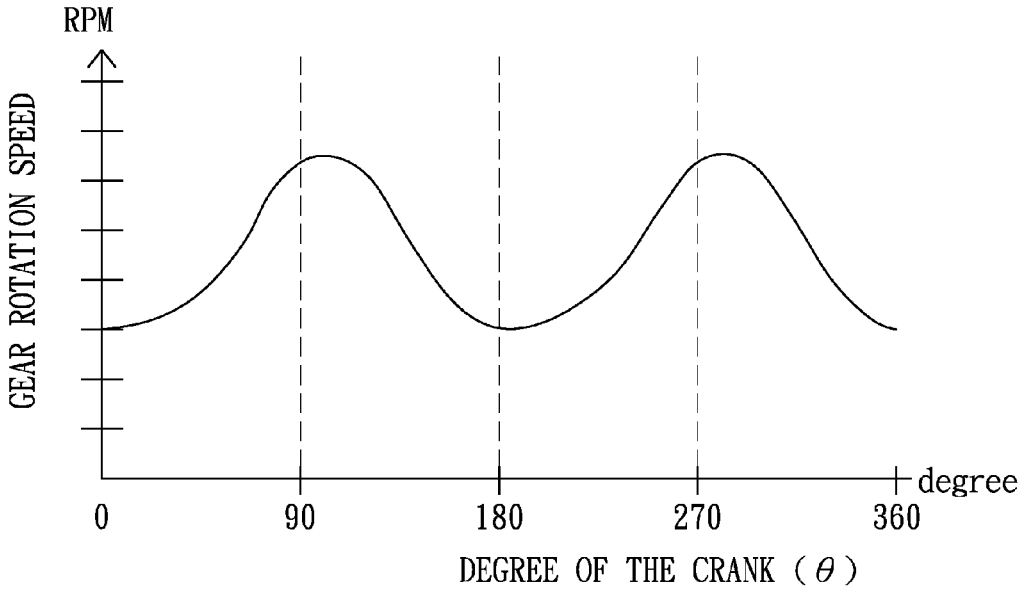
FIG. 6 is a waveform chart of a balanced exercising state.

According to the detection device 10 in accordance with the present invention, when the user steps on the treadles 26, the rotation speed detector 12 can detect the angle θ° of the crank 25 and the rotation speed RPM of the gear 22. With reference to FIG. 6, the controller 122 records the data of the angle θ° and the rotation speed RPM and then generates a waveform chart of the angle θ° and the rotation speed RPM. The waveform chart shows a relative variation of the gear 22 and the angel of the crank 25 and represents the user's exercising state.

With reference to FIG. 6, the waveform shows a balanced exercising state of the user. The rotation speed of the gear 22 rises gradually when the angle θ° of the crank 25 is within 0°-100°, which indicates that the user's right foot is exerting pressure on the treadles 26 with great effort. The rotation speed of the gear 22 decreases gradually when the angle θ° of the crank 25 is within 100°-180° because the user seldom exerts pressure on the treadles 26 in that posture. The rotation speed of the gear 22 rises gradually when the angle θ° of the crank 25 is within 180°-290°, which indicates that the user's left foot is exerting pressure on the treadles 26 with great effort. The rotation speed of the gear 22 decreases gradually when the angle θ° of the crank 25 is within 290°-360° because the user seldom exerts pressure on the treadles 26 in that posture.

Figure 7:
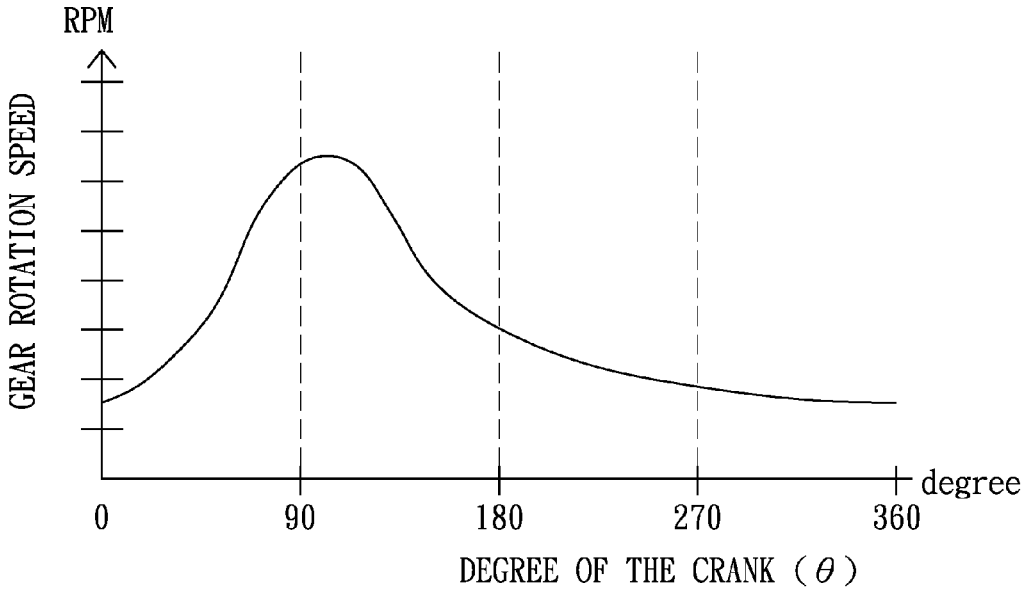
FIG. 7 is a waveform chart of an unbalanced exercising state.

With reference to FIG. 7, the rotation speed of the gear 22 does not rise when the angle θ° of the crank 25 is larger than 100°, which indicates that the user's left foot stops stepping on the treadles 26. The waveform charts of FIG. 6 and FIG. 7 show different waveforms of different working states. Hence, the user can realize whether the exercising state is in balance based on the waveform charts.

As a result, the relative variation between the gear 22 and the angel of the crank 25 indicates efforts with which the user steps on the crank 25. The user can adjust his/her exercising posture according to the waveform chart generated from the controller 122. When the user does exercises in balance, the risk of being injured decreases.

Figure 8:
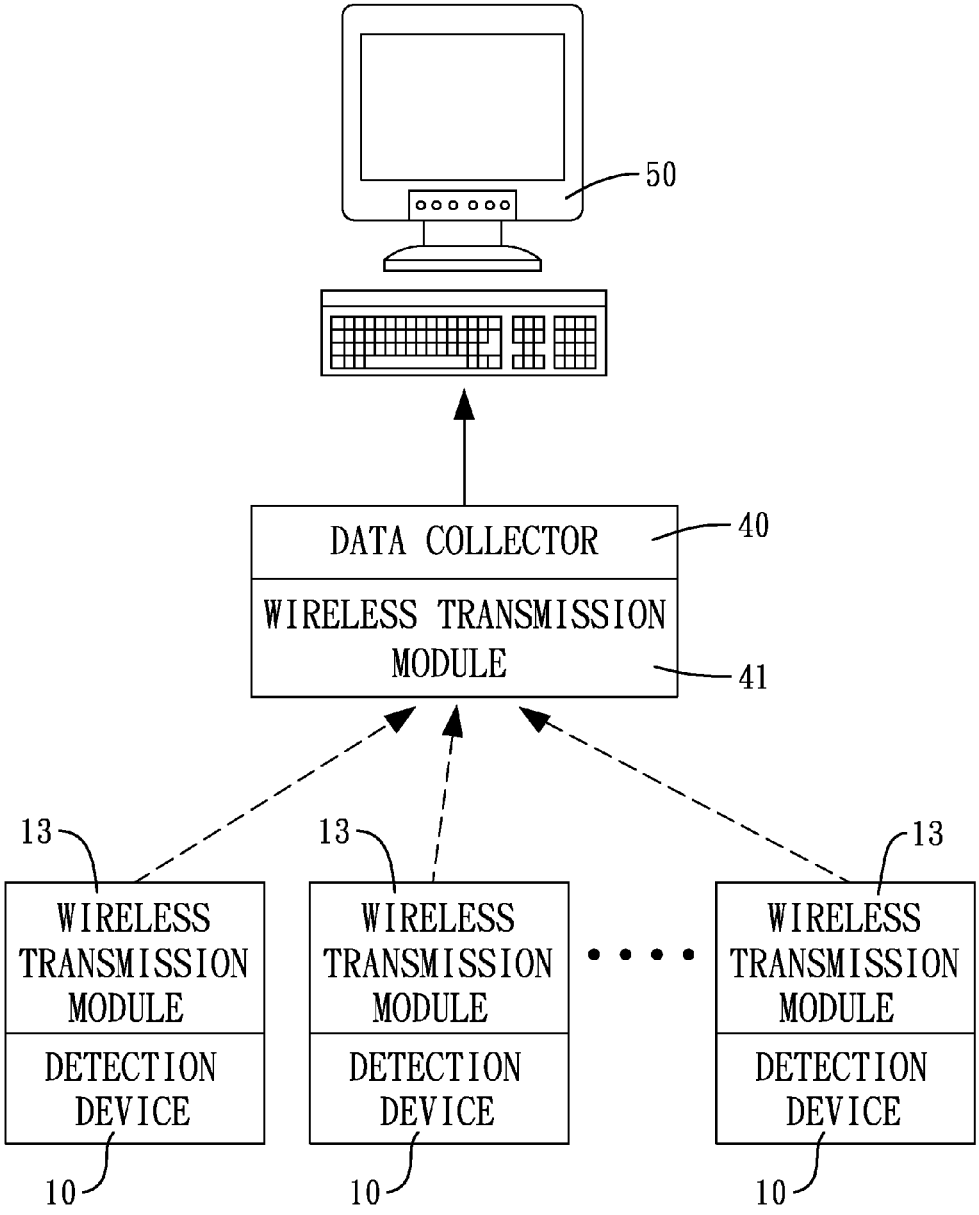
FIG. 8 is a block diagram of a monitoring system in accordance with the present invention.

With reference to FIG. 8, a block diagram of a monitoring system in accordance with the present invention comprises multiple detection devices 10 as mentioned above, a data collector 40 and a monitoring host 50.

The detection devices 10 are respectively equipped on the circulation exercise devices 21 of different physical training equipments 20 in a gym.

Each detection device 10 further comprises a wireless transmission module 13 electrically connected to the controller 122. The wireless transmission module 13 is adapted to send out information of the angle θ° and the rotation speed RPM.

The data collector 40 comprises a wireless transmission module 41 communicating with the wireless transmission modules 13 of the detection devices 10. The data collector 40 sequentially receives the information of the angle θ° and the rotation speed RPM from the detection devices 10.

The monitoring host 50 communicates with the data collector 40 via a USB port to read the information of the angle θ° and the rotation speed RPM from the data collector 40 and processes the data. The monitoring host 50 shows the data to a coach of the gym. Then the coach can take care of the users' exercising states via the monitoring host 50 and instructs the users of accurate and appropriate exercising postures if necessary.

What is claimed is:

1. A detection device detecting an exercising state adapted for a circulation exercise device of a physical training equipment, the detection device comprising:

a state detector comprising:

a circuit board; and two light sensors mounted on the circuit board, located at a circular motion trace of light blockers and breaches of the circulation exercise device, and detecting the light blockers and the breaches to generate signal combinations based on a periodic motion of the circulation exercise device, the signal combinations representing the periodic motion of the circulation exercise device; and a rotation speed detector comprising:

a memory electrically connected to the light sensors, receiving and storing the signal combinations, the signal combinations in the memory forming a periodic queue; and a controller estimating a rotation speed and angles of the circulation exercise device based on the periodic queue, wherein a relative variation between the rotation speed and the angles represents a user's exercising state.

2. The detection device as claimed in claim 1, wherein the circulation exercise device comprises a gear having n salients as the light blockers, multiple notches as the breaches and a crank mounted on the gear;

the controller defines a serial number pk to each signal combination and estimates the angle θ° of the crank and rotation speed RPM of the gear, wherein $$\theta^\circ = \frac{pk * 360^\circ}{n};$$

$$RPM = \frac{60\,(s)}{T1};$$

T1: a duration of time in which the gear finishes a complete revolution.

3. The detection device as claimed in claim 2, wherein the state detector further comprises an aperture sensor mounted on the circuit board, located at a circular motion trace of an aperture formed on the gear and detecting the aperture to generate a zeroization signal;

the controller is electrically connected to the aperture sensor and regards the zeroization signal as an initial point for defining the serial numbers pk.

4. The detection device as claimed in claim 3, wherein the controller estimates a time interval between two zeroization signals as T1.

5. The detection device as claimed in claim 1, wherein the signal combinations are combinations of digital signals including "11", "01", "00" and "10".

6. The detection device as claimed in claim 1 further comprising a wireless transmission module electrically connected to the rotation speed detector and adapted to send out information of the angle and the rotation speed.

7. The detection device as claimed in claim 2 further comprising a wireless transmission module electrically connected to the controller and adapted to send out information of the angle and the rotation speed.

8. The detection device as claimed in claim 3 further comprising a wireless transmission module electrically connected to the controller and adapted to send out information of the angle and the rotation speed.

9. The detection device as claimed in claim 4 further comprising a wireless transmission module electrically connected to the controller and adapted to send out information of the angle and the rotation speed.

10. The detection device as claimed in claim 5 further comprising a wireless transmission module electrically connected to the rotation speed detector and adapted to send out information of the angle and the rotation speed.

11. A monitoring system detecting an exercising state, the monitoring system comprising:

multiple detection devices respectively equipped on different circulation exercise devices of physical training equipments, each detection device comprising:

a state detector generating multiple signal combinations based on a periodic motion of the circulation exercise device;

a rotation speed detector electrically connected to the state detector and estimating a relative variation between a rotation speed and angles of the circulation exercise device based on the signal combinations, wherein the relative variation represents a user's exercising state; and a wireless transmission module electrically connected to the rotation speed detector and adapted to send out information of the angle and the rotation speed;

a data collector having a wireless transmission module communicating with the wireless transmission modules of the detection devices to receive information of the angle and the rotation speed from the detection devices; and a monitoring host communicating with the data collector to read information of the angle and the rotation speed.

12. The monitoring system as claimed in claim 11, wherein the state detector comprises:

a circuit board; and two light sensors mounted on the circuit board, located at a circular motion trace of light blockers and breaches of the circulation exercise device, and detecting the light blockers and the breaches to generate the signal combinations, the signal combinations representing the periodic motion of the circulation exercise device;

the rotation speed detector comprises:

a memory electrically connected to the light sensors, receiving and storing the signal combinations, the signal combinations in the memory forming a periodic queue; and a controller estimating the rotation speed and angles of the circulation exercise device based on the periodic queue.

13. The monitoring system as claimed in claim 12, wherein the circulation exercise device comprises a gear having n salients as the light blockers, multiple notches as the breaches and a crank mounted on the gear;

the controller defines a serial number pk to each signal combination and estimates the angle θ° of the crank and rotation speed RPM of the gear, wherein $$\theta^\circ = \frac{pk * 360^\circ}{n};$$

$$RPM = \frac{60\ (s)}{T1};$$

T1: a duration of time in which the gear finishes a complete revolution.

14. The monitoring system as claimed in claim 13, wherein the state detector further comprises an aperture sensor mounted on the circuit board, located at a circular motion trace of an aperture formed on the gear and detecting the aperture to generate a zeroization signal; and the controller is electrically connected to the aperture sensor and regards the zeroization signal as an initial point for defining the serial numbers pk.

15. The monitoring system as claimed in claim 14, wherein the controller estimates a time interval between two zeroization signals as T1.

16. The monitoring system as claimed in claim 11, wherein the signal combinations are combinations of digital signals including “11”, “01”, “00” and “10”.

* * * * *